US010627754B1

(12) United States Patent
Yokoyama

(10) Patent No.: US 10,627,754 B1
(45) Date of Patent: Apr. 21, 2020

(54) FIXING DEVICE AND IMAGE FORMING APPARATUS

(71) Applicant: TOSHIBA TEC KABUSHIKI KAISHA, Shinagawa-ku, Tokyo (JP)

(72) Inventor: Shuji Yokoyama, Nagaizumi Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/276,849

(22) Filed: Feb. 15, 2019

(51) Int. Cl.
*G03G 15/20* (2006.01)

(52) U.S. Cl.
CPC ..... *G03G 15/2053* (2013.01); *G03G 15/2039* (2013.01); *G03G 15/2064* (2013.01); *G03G 2215/2025* (2013.01)

(58) Field of Classification Search
CPC ..... G03G 15/2017; G03G 15/2039; G03G 15/2053
See application file for complete search history.

(56) References Cited

U.S. PATENT DOCUMENTS

2013/0164055 A1* 6/2013 Tokuhiro ..... G03G 15/2039 399/329

FOREIGN PATENT DOCUMENTS

JP 2009-265241 11/2009

* cited by examiner

*Primary Examiner* — Thomas S Giampaolo, II
(74) *Attorney, Agent, or Firm* — Amin, Turocy & Watson, LLP

(57) ABSTRACT

According to one embodiment, a fixing device includes a heating rotating body having an first arched portion so that a first circular arc is formed in a cross section configured to rotate to be pressed against a medium so as to heat toner on the medium and an auxiliary heat-generating member having a second arched portion so that a second circular arc is formed in the cross section, the second arched portion being smaller than the first arched portion, configured to be supported at one end by a support member so as to be movable inside the heating rotating body and configured to contact with the first arced portion of the heating rotating body, the contact portion between the first arched portion and the second arched portion being closer to the support member than a middle point of the second circular arc in the cross section.

18 Claims, 8 Drawing Sheets

FIXING DEVICE AND IMAGE FORMING APPARATUS

FIELD

Embodiments described herein relate generally to a fixing device and an image forming apparatus, and methods related thereto.

BACKGROUND

In an image forming apparatus such as a copy machine and a printer, a fixing device is used that heats a heating rotating body such as a fixing belt including a conductive layer (a heat-generating layer) that generates heat by an electromagnetic induction heating (IH) device. Such a fixing device includes an auxiliary heat-generating member disposed to be in contact with the heating rotating body.

When the temperature thereof is lower than the Curie temperature, the auxiliary heat-generating member exhibits ferromagnetism and heats the fixing belt by forming a magnetic path. On the other hand, when the temperature exceeds the Curie temperature, the auxiliary heat-generating member is changed from the ferromagnetism to paramagnetism, and the magnetic path is not formed therein, whereby the fixing belt is not heated. Since the magnetic member is formed of a magnetic shunt alloy, a temperature rise in the fixing belt is facilitated when the temperature is low and excessive heating on the fixing belt is suppressed when the temperature is high with the Curie temperature as a boundary. Further, in such a fixing device, a thermostat operating depending on the temperature of the auxiliary heat-generating member is used together therewith. The thermostat is disposed to be in contact with the auxiliary heat-generating member, and operates when the temperature of the fixing device becomes higher than a predetermined temperature, thereby interrupting power supply to the IH device.

DETAILED DESCRIPTION

Figure 1:
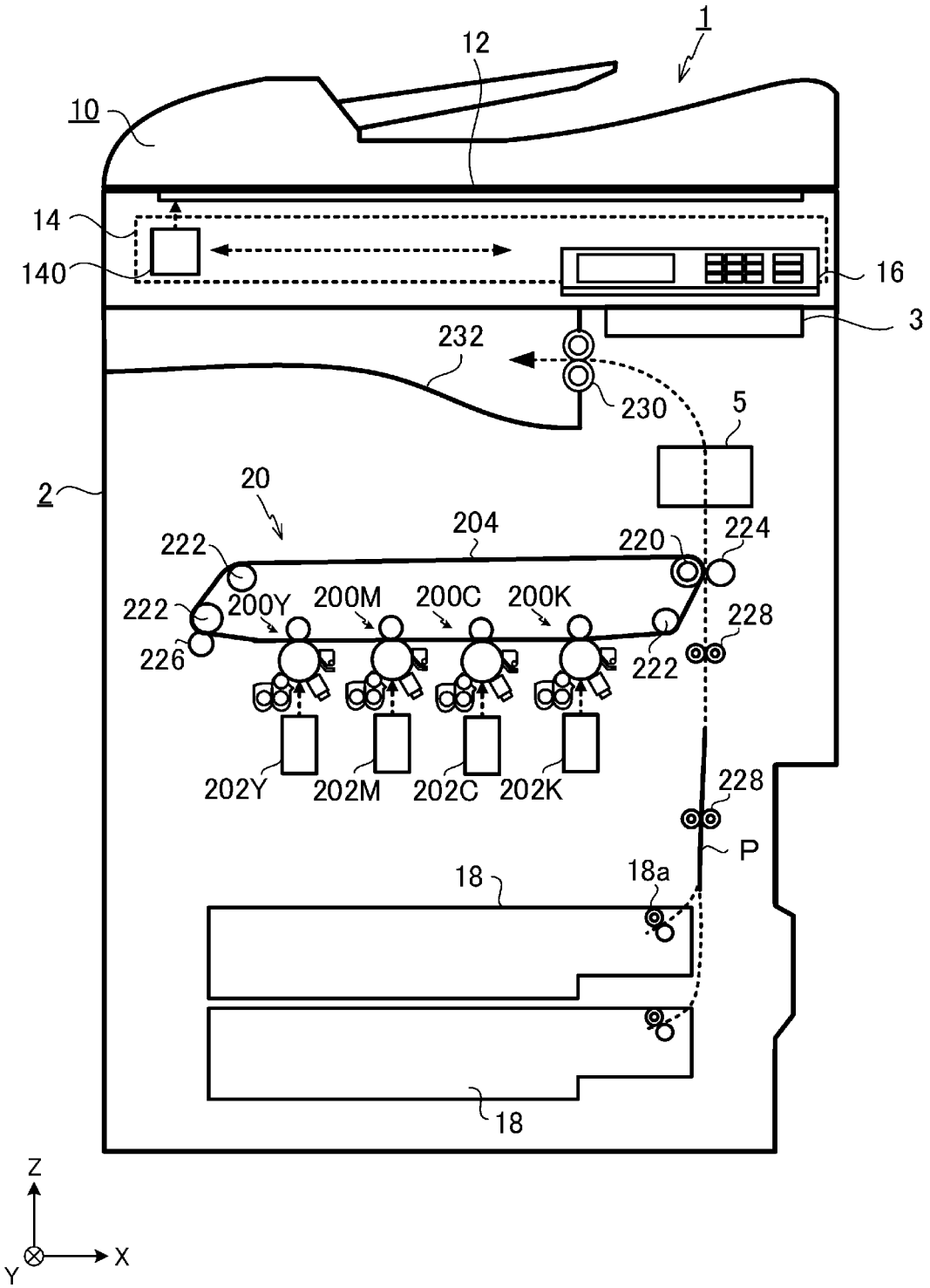
FIG. 1 is a view illustrating a configuration of an image forming apparatus according to an embodiment.

When heat transport between the heating rotating body and the auxiliary heat-generating member is not desirably performed, the temperature of the auxiliary heat-generating member greatly exceeds the temperature of the heating rotating body due to the self-heat generation of the auxiliary heat-generating member. In this case, there exists a possibility that the thermostat operates such that the power supply to the IH device is unnecessarily interrupted. Further, for example, when a type of thermostat that does not perform self-restoration after the power supply is interrupted is used, after the operation thereof, a drawback that the image forming apparatus is not restarted until the thermostat is replaced may occur. In order to prevent the aforementioned drawback, it is required to sufficiently bring the heating rotating body and the auxiliary heat-generating member into close contact with each other, thereby appropriately performing the heat transport therebetween.

In general, according to one embodiment, a fixing device includes a heating rotating body that has an inner cross section of a first circular arc and conductivity, rotates to be pressed against a medium, generates heat due to an electromagnetically induced current, and heats a toner transferred to the medium to be fixed; an induction current generator that is disposed along the heating rotating body, electromagnetically induces the heating rotating body by receiving supplied power, and generates heat by generating a current; and an auxiliary heat-generating member that has a cross section of a second circular arc smaller than the first circular arc, is supported at one side of the cross section by a support member inside the heating rotating body, and is in close contact with the first circular arc included in the heating rotating body at a close contact portion closer to the support member compared to a middle point of the second circular arc.

First Embodiment

Hereinafter, a first embodiment will be described in detail with reference to the drawings. Further, hereinafter, in the drawings, a ratio of dimensions of each component is not necessarily required to be equal to that in implementation of the embodiment. Further, in order to indicate a certain component, an outside portion of the component is appropriately indicated by a dotted line, or a portion hidden by other components is indicated by a dotted line. Further, an XYZ coordinate system that is formed of an X axis, a Y axis and a Z axis is appropriately used in the following embodiments and drawings. Further, a component that is not essential to the embodiment and is not essential to the description will be appropriately omitted. Further, the substantially same components will be denoted by the same reference sign and symbol.

FIG. 1 is a view illustrating a configuration of an image forming apparatus 1 according to an embodiment. The image forming apparatus 1 is, for example, a multi-function peripheral (MFP). The image forming apparatus 1 performs image formation and the like for performing printing on paper P according to a printing instruction from a user.

The image forming apparatus 1 includes a main body part 2, a control device 3, and an automatic document feeder (ADF) 10 disposed above the main body part 2. An original document table 12 that is formed of transparent glass is disposed on an upper part of the main body part 2, and the automatic document feeder (ADF) 10 is provided to be rotatable up and down on an upper surface side of the original document table 12. Further, an operation panel 16 is provided on an upper part of the main body part 2. The operation panel 16 includes various buttons and a display device (not illustrated), displays an image for a GUI (Graphical User Interface) on the display device, and receives a user's operation with respect to the various buttons and the image for the GUI.

A scanner 14 for reading an original document is provided below the original document table 12. The scanner 14 reads an original document sent by the automatic document feeder 10 or an original document placed on the original document table 12, thereby generating image data. The scanner 14 includes an image sensor 140.

When the image sensor 140 reads an image of the original document placed on the original document table 12, the image of the original document is read while moving in a +X direction along the original document table 12. Further, when reading the image of the original document supplied onto the original document table 12 by the automatic document feeder 10, the image sensor 140 is fixed at a position illustrated in FIG. 1 and sequentially reads the images of the original documents to be sent for each original document.

An image forming unit 20 is disposed inside the main body part 2. The image forming unit 20 forms an image obtained by rendering image data inputted from the scanner 14 or a personal computer on a recording medium such as paper stored in a paper feed cassette 18.

The image forming unit 20 includes process units 200Y, 200M, 200C, and 200K that perform an image forming process for forming a latent image of an image by using toners of yellow (Y), magenta (M), cyan (C), and black (K) of respective powder; scanning heads 202Y, 202M, 202C, and 202K that are provided respectively corresponding to the process units 200Y, 200M, 200C, and 200K; an intermediate transfer belt 204; and the like.

The process units 200Y, 200M, 200C, and 200K are disposed below the intermediate transfer belt 204. In the image forming unit 20, the process units 200Y, 200M, 200C, and 200K are disposed from the −X side to the +X side. The scanning heads 202Y, 202M, 202C, and 202K are respectively disposed below the process units 200Y, 200M, 200C, and 200K.

Figure 2:
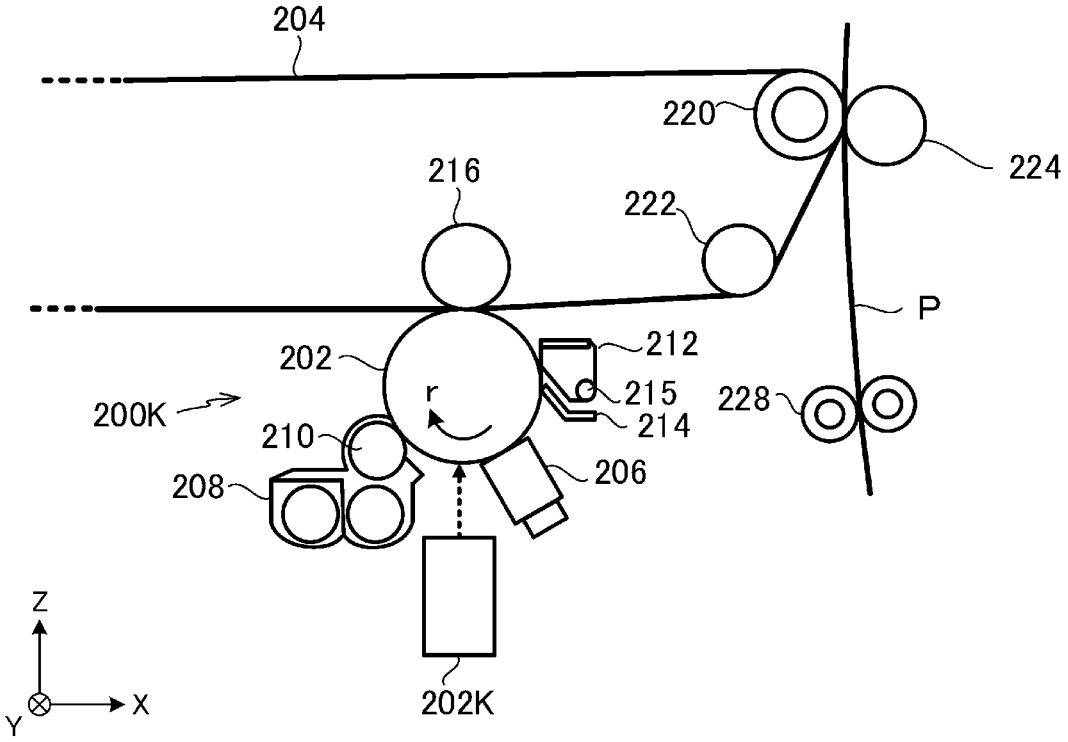
FIG. 2 is an enlarged view illustrating one of four process units illustrated in FIG. 1.

FIG. 2 is an enlarged view illustrating the process unit 200K among the process units 200Y, 200M, 200C, and 200K. Since all of the process units 200Y, 200M, 200C, and 200K have the same configurations, the process unit 200K will be exemplified for describing the respective configurations of the image forming unit.

The process unit 200K includes a photoconductive drum 202 of an image carrier. An electrifying charger 206, a developing unit 208, a cleaner 212, a primary transfer roller 216, and the like are disposed around the photoconductive drum 202 in a direction indicated by an arrow r. An exposure position of the photoconductive drum 202 is irradiated with laser light from the scanning head 202K. An electrostatic latent image is formed on a surface of the photoconductive drum 202 by irradiating the surface of the rotating photoconductive drum 202 with the laser light.

The electrifying charger 206 of the process unit 200K uniformly electrifies the surface of the photoconductive drum 202. The developing unit 208 supplies a toner to the photoconductive drum 202 by a developing roller 210 to which developing bias is applied, and then develops the electrostatic latent image. The cleaner 212 removes the toner remaining on the surface of the photoconductive drum 202 by using a tip of a blade 214. The toner scraped off by the tip of the blade 214 is conveyed in a +Y axis direction by an auger 215.

As illustrated in FIG. 1, the intermediate transfer belt 204 is stretched over a drive roller 220 and three driven rollers 222. The intermediate transfer belt 204 rotates in a counterclockwise direction in FIG. 1 by rotation of the drive roller 220. Further, as illustrated in FIG. 1, the intermediate transfer belt 204 contacts the respective upper surfaces of the photoconductive drums 202 of the process units 200Y, 200M, 200C, and 200K.

A primary transfer voltage is applied to a position of the intermediate transfer belt 204 facing the photoconductive drum 202 by the primary transfer roller 216. Accordingly, a toner image developed on the surface of the photoconductive drum 202 is primarily transferred to the intermediate transfer belt 204.

A secondary transfer roller 224 is disposed to face the drive roller 220 that stretches the intermediate transfer belt 204. When the paper P passes through between the drive roller 220 and the secondary transfer roller 224, a secondary transfer voltage is applied to the paper P by the secondary transfer roller 224. Accordingly, the toner image formed on the intermediate transfer belt 204 is secondarily transferred to the paper P. As illustrated in FIG. 1, a belt cleaner 226 is provided in the vicinity of the driven roller 222 of the intermediate transfer belt 204. A residual toner on the surface of the intermediate transfer belt 204 is removed by the belt cleaner 226.

As illustrated in FIG. 1, a paper feed roller 228 is provided between the paper feed cassette 18 and the secondary transfer roller 224. The paper P that is taken out from the paper feed cassette 18 by a pickup roller 18*a* disposed in the vicinity of the paper feed cassette 18 is conveyed between the intermediate transfer belt 204 and the secondary transfer roller 224 by the paper feed roller 228.

A fixing device 5 is provided above the secondary transfer roller 224. Further, a paper discharge roller 230 is provided above the fixing device 5. The paper P that passed through between the intermediate transfer belt 204 and the secondary transfer roller 224 is heated in the fixing device 5. The paper P that passed through the fixing device 5 is discharged to a paper discharge tray 232 by the paper discharge roller 230.

Figure 3:
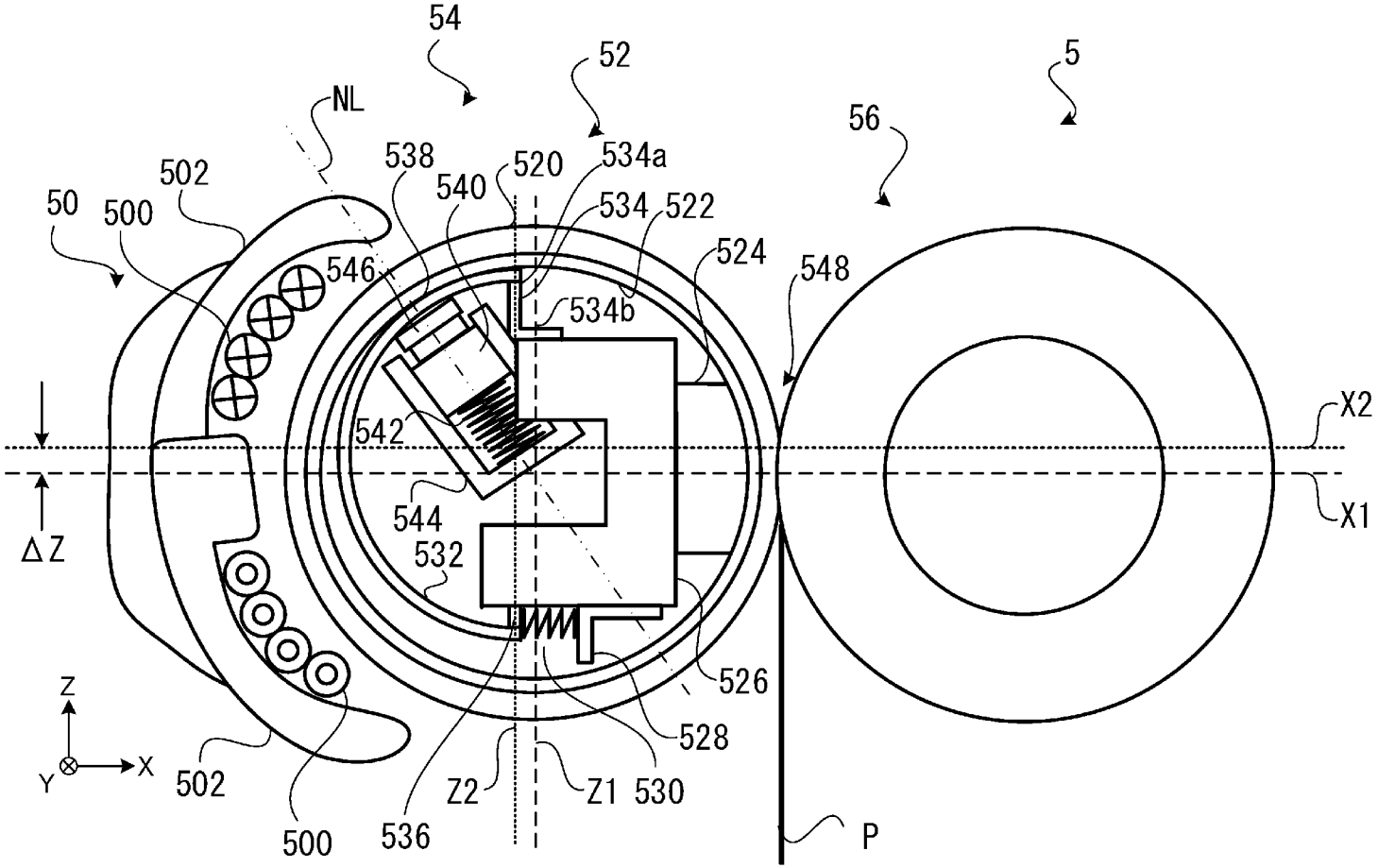
FIG. 3 illustrates a side view of a fixing device according to a first embodiment.
Figure 4:
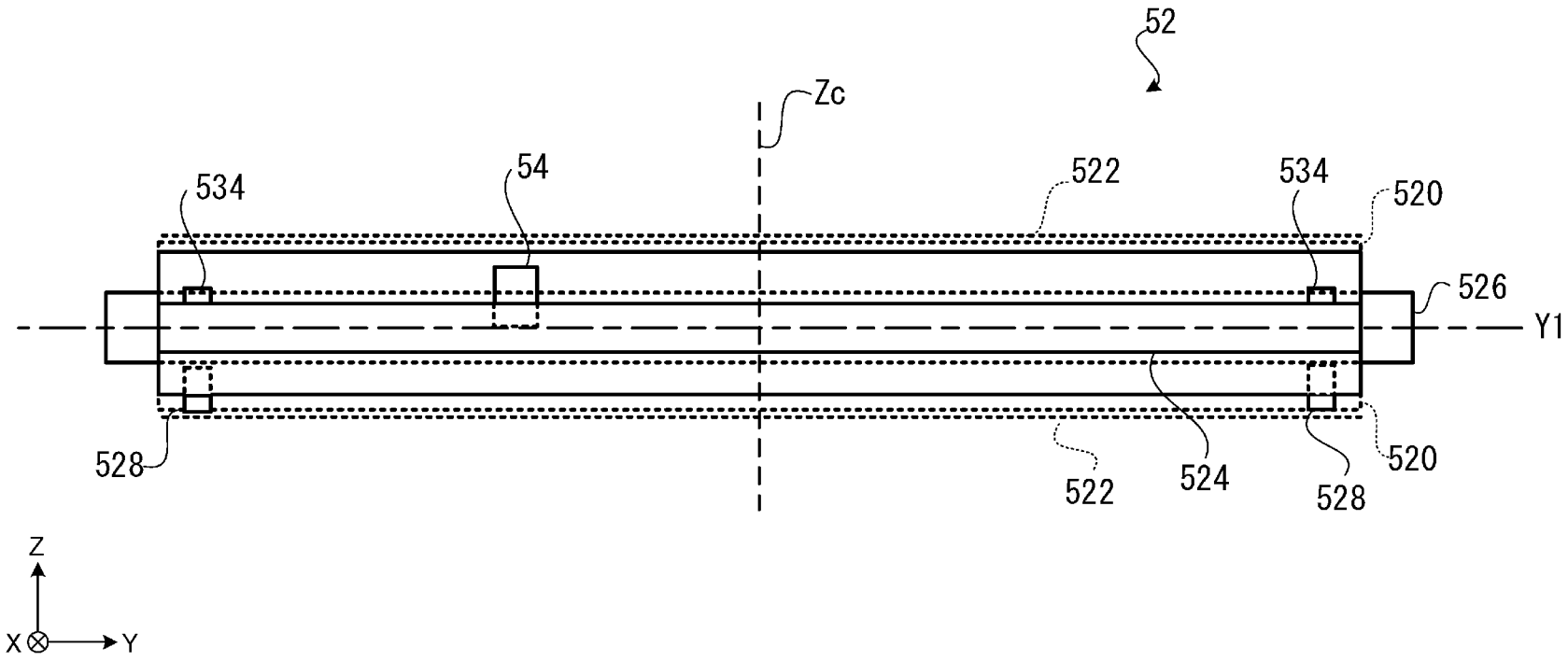
FIG. 4 illustrates a front view of a fixer.

FIG. 3 illustrates a side view of the fixing device 5 according to the first embodiment. FIG. 4 illustrates a front view of a fixer 52 of the fixing device 5. As illustrated in FIGS. 3 and 4, the fixing device 5 includes an electromagnetic induction heating device 50 (hereinafter referred to as "IH device 50") and the fixer 52. The fixer 52 includes a fixing belt 520 and a pressure roller 56.

The IH device 50 is disposed along the fixing belt 520. The IH device 50 includes a coil 500 and a core 502 that regulates magnetic flux by covering an outer periphery of the coil 500.

The fixing belt 520 is a heating rotating body having an endless cylindrical shape. More specifically, a cross section perpendicular to a longitudinal direction of the fixing belt 520 is, for example, a substantial circle having a diameter of 3 cm to 4 cm, and a rotation center of the fixing belt 520 passes a center of the circle in a ±Y direction. However, since the fixing belt 520 is deformed by the pressure roller 56, the cross section of the fixing belt 520 is deviated from a circular arc forming a part of the circle at a portion in contact with the pressure roller 56. Further, the rotation center of the fixing belt 520 is illustrated as an intersection of dotted lines X1 and Z1 in FIG. 3, and is illustrated as a dotted line Y1 in FIG. 4.

The fixing belt 520 includes a layer that generates heat by induction due to a magnetic field of the IH device 50, for example, a conductive layer 522 that is formed of a conductive material such as iron, nickel, and copper, as a heat-generating layer. Opposite end parts of the fixing belt 520 in the longitudinal direction are rotatably supported by a roller (not illustrated). The conductive layer 522 also has an endless cylindrical shape similar to the fixing belt 520, and shares the rotation center with the fixing belt 520. An elastic layer that is formed of an elastic body such as silicone rubber is formed on a surface of the conductive layer 522, and a release layer having good releasability from the toner is formed on a surface of the elastic layer.

When alternating current power having high frequency is supplied to the coil 500 of the IH device 50, the coil 500 generates magnetic flux and applies the generated magnetic flux to the conductive layer 522 of the fixing belt 520, thereby generating an eddy-current. When the eddy-current is generated, the conductive layer 522 generates heat, thereby heating the conductive layer 522 itself and the fixing belt 520, and further heating the paper P passing through between the fixing belt 520 and the pressure roller 56. When the alternating current power to the coil 500 is shut off by a thermostat 54, the magnetic flux is not generated. Accordingly, since the eddy-current is not generated in the conductive layer 522 of the fixing belt 520, and a magnetic member 532 having a temperature lower than a Curie temperature Tc, the conductive layer 522 and the magnetic member 532 do not generate the heat.

Further, a pressure pad 524, a support frame 526, the magnetic member 532, and the thermostat 54 are disposed inside the fixing belt 520. The support frame 526 supports the fixing belt 520 and a pressing spring 542, and further supports the magnetic member 532 and the thermostat 54. A support member 534 is mounted on the support frame 526 in parallel to an upper side surface thereof, and the support member 534 supports the magnetic member 532.

The pressure pad 524 is a pressure member formed of, for example, a mold of a liquid crystal polymer (LCP), and is fixed to and supported by the support frame 526 at a position to face the pressure roller 56 while the fixing belt 520 is interposed therebetween. The pressure pad 524 pressurizes the fixing belt 520 from an inner peripheral part toward a direction of the pressure roller 56. The pressure roller 56 is deformed by being pressed against the fixing belt 520, and a nip part 548 is formed between the pressure roller 56 and the fixing belt 520.

The magnetic member 532 is formed of a material having a lower Curie temperature Tc than that of the conductive layer 522 of the fixing belt 520, for example, an iron-nickel magnetic shunt alloy. The Curie temperature Tc of the magnetic member 532 is, for example, 200° C. When the temperature of the magnetic member 532 exceeds the Curie temperature Tc, the magnetic member 532 is changed from ferromagnetism to paramagnetism. When the temperature of the magnetic member 532 exceeds the Curie temperature Tc, a magnetic path is not formed inside the magnetic member 532, whereby the magnetic member 532 does not heat the fixing belt 520 and the conductive layer 522.

By forming the magnetic member 532 with a magnetic shunt alloy, when the temperature of the magnetic member 532 is lower than the Curie temperature Tc, the temperature thereof rises by heating the conductive layer 522 of the fixing belt 520, on the other hand, when the temperature of the magnetic member 532 is higher than the Curie temperature Tc, heat is removed from the fixing belt 520 and the conductive layer 522 to prevent heating. Further, a magnetic characteristic of the magnetic member 532 has thermal reversibility, and thus when the temperature is lowered from a temperature equal to or higher than the Curie temperature Tc to a temperature lower than the Curie temperature Tc, the magnetic member 532 returns from the paramagnetic body to the ferromagnetic body.

As illustrated in FIG. 3, the magnetic member 532 is fixed and supported by the support frame 526 via the support member 534, faces the IH device 50, abuts on an inner side of the conductive layer 522 of the fixing belt 520, and is disposed to be in close contact with the conductive layer 522 at a close contact portion 538.

Further, a shape of the close contact portion 538 may be a line or an elongated surface. A cross section perpendicular to a longitudinal direction of the magnetic member 532 is a circular arc that substantially forms a part of a circle. In FIG. 3, a center of the circular arc of the cross section of the magnetic member 532 is indicated by an intersection of dotted lines X2 and Z2. A radius of the circle thereof is shorter than a radius of the circle of the cross section of the fixing belt 520 and the conductive layer 522, and further the center of the circular arc thereof is on the dotted line X2.

Further, in FIG. 3, a distance between the rotation center of the fixing belt 520 and the conductive layer 522, that is, the dotted line X1 passing through the centers of the circles of these cross sections, and the dotted line X2 passing through the center of the circular arc of the cross section of the magnetic member 532 is indicated by AZ. As illustrated in FIG. 3, the center of the circular arc of the cross section of the magnetic member 532 is deviated from the rotation center of the fixing belt 520 and the conductive layer 522 to the +Z side and −X side.

That is, in the circular arc of the cross section of the magnetic member 532 included on the X-Z plane, a distance from a bending part 534*a* of the support member 534 to the close contact portion 538 is shorter than a distance from the bending part 534*a* of the support member 534 to a middle point of the circular arc thereof. Further, the center of the circle including the circular arc of the cross section of the magnetic member 532 is positioned closer to the close contact portion 538 compared to the center of the circle of the cross section of the fixing belt 520 and the conductive layer 522 in the vicinity of the close contact portion 538.

Figure 5:
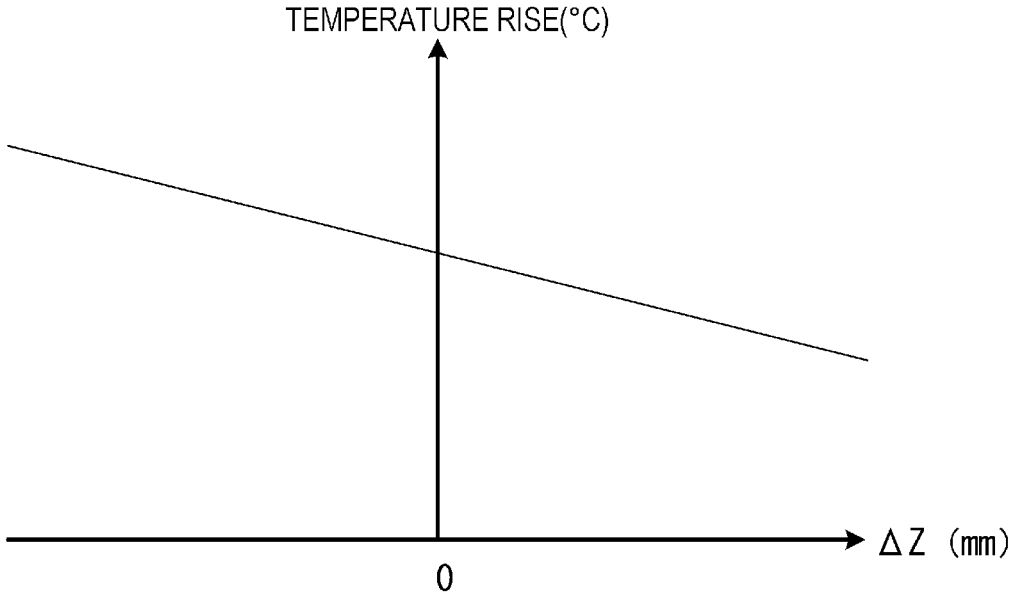
FIG. 5 is a diagram illustrating a correlation between a distance ΔZ and a temperature rise in a temperature detection component of a thermostat main body.

FIG. 5 is a diagram illustrating a correlation between the distance ΔZ (mm) illustrated in FIG. 3 and a temperature rise in a temperature detection component 546 of a thermostat main body 540. As the distance ΔZ is large, adhesion between the conductive layer 522 of the fixing belt 520 and the magnetic member 532 becomes high, whereby an amount of heat transport between the magnetic member 532, and the fixing belt 520 and the conductive layer 522 increases.

Therefore, as illustrated in FIG. 5, when the temperature of the magnetic member 532 is lower than the Curie temperature Tc, a negative correlation is generated between the distance ΔZ and the temperature rise in the temperature detection component 546 of the thermostat main body 540 pressed against the close contact portion 538 between the fixing belt 520 and the magnetic member 532. This correlation can be quantitatively obtained by experiments or simulations. In order for the thermostat 54 to be appropriately operated, the distance ΔZ is required to be set as an optimized value based upon the correlation, and in the fixer 52, for example, the distance ΔZ is set to be about +1 mm.

As illustrated in FIG. 3, the thermostat 54 includes the thermostat main body 540, the pressing spring 542, and a thermostat holder 544. The thermostat holder 544 accommodates the thermostat main body 540 and the pressing spring 542.

The thermostat holder 544 is supported by the support frame 526 toward a direction in which a longitudinal axis of the thermostat 54 and a normal line NL of the close contact portion 538 between the conductive layer 522 of the fixing belt 520 and the magnetic member 532 substantially coincide with each other on the X-Z plane.

When the distance ΔZ is about 1 mm, the conductive layer 522 of the fixing belt 520 and the magnetic member 532 are optimally in close contact with each other, whereby heat exchange therebetween is optimally performed. At this time, the distance from the bending part 534*a* of the support member 534 to the close contact portion 538 is shorter than a distance from the close contact portion 538 to a spring receiving member 536. The pressing spring 542 presses the temperature detection component 546 of the thermostat 54 against the close contact portion 538 in which the conductive layer 522 of the fixing belt 520 and the magnetic member 532 are in contact with each other, and further become in close contact with each other. When the temperature of the temperature detection component 546 exceeds an operating temperature of the thermostat 54, the thermostat 54 is operated, thereby interrupting the supply of alternating current power to the IH device 50.

Further, as illustrated in FIG. 4, the thermostat 54 passes through a center in the longitudinal direction of the magnetic member 532, and is disposed at a positioned deviated in a right direction (+Y direction) or a left direction (−Y direction) in FIG. 4 with respect to a dotted line Zc that is perpendicular to a dotted line Y2 passing through the circular arc of the cross section of the magnetic member 532 and is along the Z axis. Further, in FIG. 4, a case in which the thermostat 54 is disposed in the left direction of the dotted line Zc is exemplified.

As illustrated in FIGS. 3 and 4, the support member 534 is formed in a vertically downward direction (−Z direction) at opposite end parts on the upper side (+Z side) of the magnetic member 532. An end part 534*b* of the support member 534 is mounted on the support frame 526. The support member 534 enables the magnetic member 532 to slightly oscillate in the left and right direction (±X direction) following the movement of the conductive layer 522 of the fixing belt 520, and causes the magnetic member 532 to closely contact the conductive layer 522 of the fixing belt 520.

The spring receiving member 536 is formed in a vertically upward direction (+Z direction) at opposite end parts on the lower side (−Z side) of the magnetic member 532. On the other hand, a pressing member 528 is disposed at a portion facing the spring receiving member 536 at opposite end parts on the lower side (−Z side) of the support frame 526. A pressing spring 530 is disposed between the spring receiving member 536 and the pressing member 528. The pressing spring 530 presses the magnetic member 532 in the left direction (−X direction) in FIG. 3, and presses the magnetic member 532 against the conductive layer 522 of the fixing belt 520 with a pressure of about 300 g.

As illustrated in FIG. 3, the position of the center of the circular arc of the cross section of the magnetic member 532, the radius of the circle including the circular arc thereof, and the position and the shape of the close contact portion 538 between the conductive layer 522 of the fixing belt 520 and the magnetic member 532 can be appropriately obtained by a manufacturer of the image forming apparatus 1 through experiments or simulations. When the shape and the position thereof are obtained by the simulations, in addition to a shape and a material of each component of the fixing device 5, a conveyance speed of the paper P, the number of the paper P, heat generated by sliding friction at the close contact portion 538 between the conductive layer 522 of the fixing belt 520 and the magnetic member 532, and the like also can be taken into consideration.

The pressure roller 56 illustrated in FIG. 3 is a pressure rotating member, is disposed to face and to be along the fixing belt 520, and rotates around rotation centers provided at opposite ends. The fixing device 5 rotationally drives the pressure roller 56 by a motor (not illustrated). When the pressure roller 56 rotates, the fixing belt 520 and the conductive layer 522 follow the rotation of the pressure roller 56 and rotate around the pressure roller 56. In the fixing device 5, the pressure roller 56 rotates in the left direction in FIG. 3, and the fixing belt 520 and the conductive layer 522 rotate in the left direction in FIG. 3.

In the nip part 548, the paper P is nipped between the rotating fixing belt 520 and the pressure roller 56, and is conveyed in an upward direction (+Z direction) in FIG. 3. The toner transferred onto the paper P is heated at about 130° C. to 170° C. in the nip part 548 and is melted by receiving pressure, thereby being fixed to the paper P.

Figure 6:
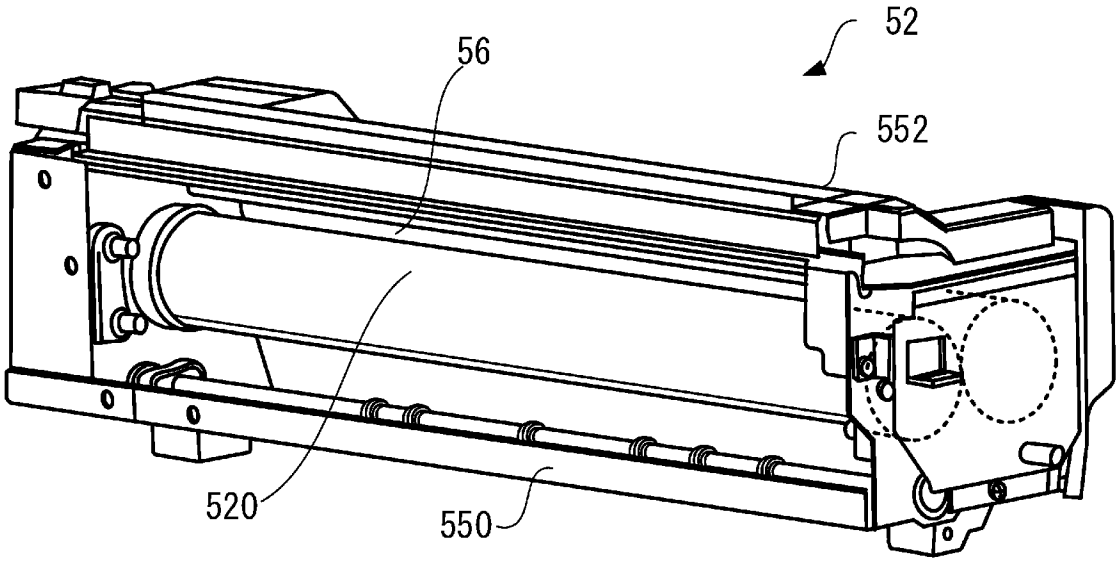
FIG. 6 is a perspective view illustrating a part of the fixer.

FIG. 6 is a perspective view illustrating a part of the fixer 52 illustrated in FIG. 3. The fixer 52 further includes a frame 550, and the fixing belt 520, the conductive layer 522, and the pressure roller 56 are rotatably mounted on the frame 550. Further, parts other than the fixing belt 520 mounted on the frame 550 and a surface of the pressure roller 56 on a side of the fixing belt 520 are covered with a cover 552.

The fixer 52 is fixed to a plate (not illustrated) inside the main body part 2 of the image forming apparatus 1. Further, the IH device 50 (not illustrated in FIG. 6) is further disposed on a side of the frame 550 (a front side in FIG. 6) of the fixer 52.

Hereinafter, an image forming process in the image forming apparatus 1 will be described. When image formation is performed, the paper P is pulled out of the paper feed cassette 18 by a pickup roller 18*a* (FIG. 1), and is conveyed between the intermediate transfer belt 204 and the secondary transfer roller 224 by the paper feed roller 228.

In parallel with the above-mentioned process, an image that is constituted by an erasable toner is formed on the photoconductive drum 202 in the process unit 200C. The image of the erasable toner formed on the photoconductive drum 202 of each process unit 200C is sequentially transferred to the intermediate transfer belt 204. Accordingly, the toner image that is formed of one or more of yellow (Y), magenta (M), cyan (C), and black (K) is formed on the intermediate transfer belt 204.

When the paper P conveyed between the intermediate transfer belt 204 and the secondary transfer roller 224 passes through between the intermediate transfer belt 204 and the secondary transfer roller 224, the toner image formed on the intermediate transfer belt 204 is transferred to the paper P.

Prior to or in parallel with the above-mentioned process, the IH device 50 heats the conductive layer 522 according to control by the control device 3 of the image forming apparatus 1, and further heats the fixing belt 520 (FIGS. 3, 4, and 6) up to a predetermined temperature. The magnetic member 532 keeps the conductive layer 522 of the fixing belt 520 at an appropriate temperature. The pressing member 528 and the pressing spring 530, and the support member 534 and the spring receiving member 536 of the magnetic member 532 oscillate the magnetic member 532 to follow the movement of the conductive layer 522 of the fixing belt 520, thereby closely contacting the conductive layer 522.

The paper P to which the toner is transferred is conveyed to the fixing device 5, and then is heated and pressurized at the nip part 548 formed by the fixing belt 520 and the magnetic member 532. As a result, an image by the toner is formed on the paper P. The paper P on which the image is formed is conveyed by the paper discharge roller 230, and is discharged to the paper discharge tray 232. Further, when the temperature detection component 546 exceeds the predetermined temperature for reducing the power supply to the IH device 50, that is, the temperature of the Curie temperature Tc+α (α≥0), the thermostat 54 is operated, thereby shutting off the alternating current power to the IH device 50.

In the fixing device 5 described above, the magnetic member 532 is positioned inside the conductive layer 522 of the fixing belt 520 to optimize, and for example, maximize efficiency of the heat transport therebetween, is inscribed on the conductive layer 522 of the fixing belt 520, and then is pressed against the conductive layer 522 of the fixing belt 520 by the pressing spring 530 and the like. Accordingly, the temperature of the temperature detection component 546 of the thermostat 54 and the rotational load to the conductive layer 522 of the fixing belt 520 are optimized, and further, it is possible to prevent unnecessary interruption of the alternating current power supply to the IH device 50 by the thermostat 54.

Second Embodiment

Figure 7:
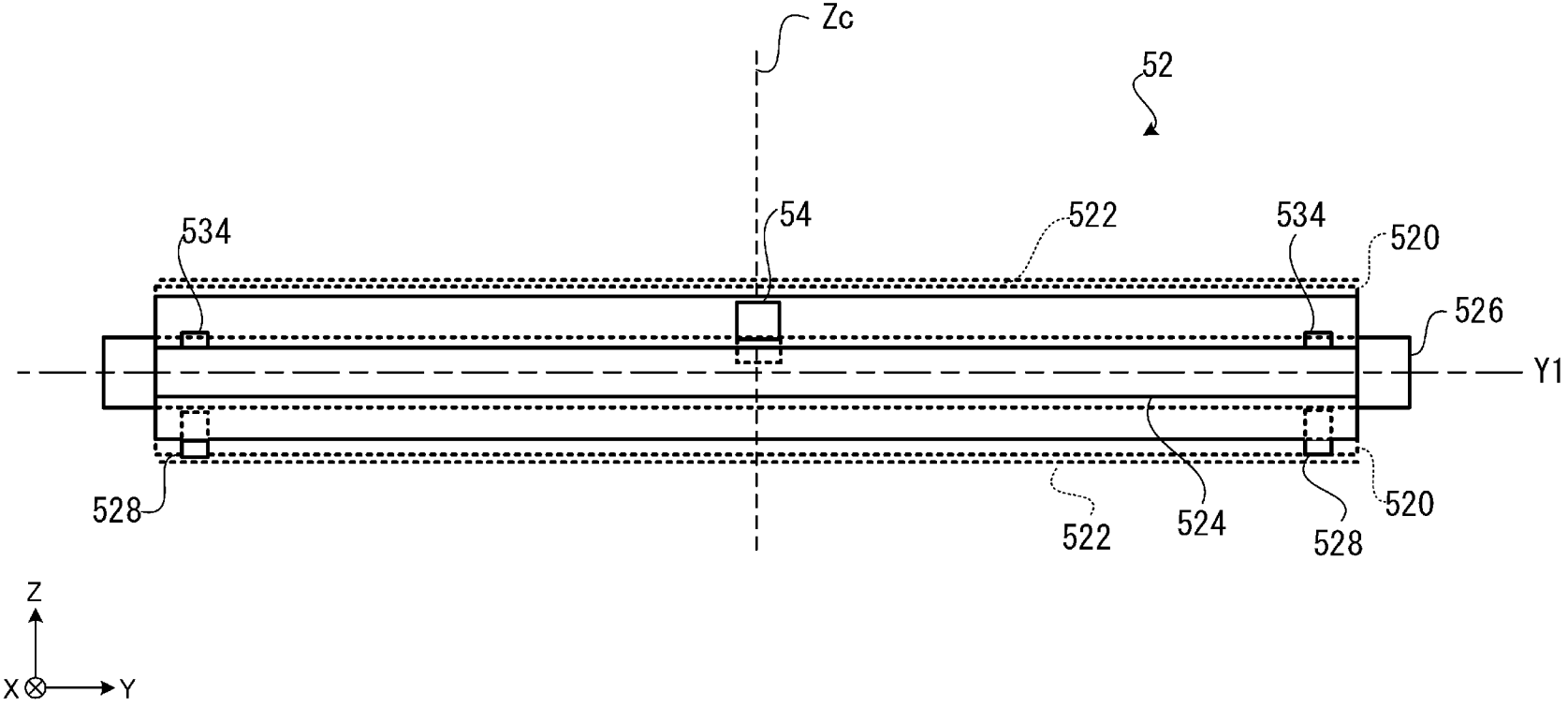
FIG. 7 illustrates a front view of a fixer of a fixing device according to a second embodiment.

Hereinafter, a second embodiment will be described in detail with reference to the drawings. FIG. 7 illustrates a front view of a fixer 52 of a fixing device 5 according to the second embodiment. As illustrated in FIG. 7, in the fixer 52 according to the second embodiment, the thermostat 54 is disposed at a center portion in the longitudinal direction of the magnetic member 532.

In the case of the support by the support frame 526 (FIGS. 3 and 4) of the magnetic member 532 via the support member 534, since a margin is appropriately provided depending on the configuration of the image forming apparatus 1 and accuracy of a manufacturing device, a backlash occurs in the up and down direction (±Z direction) at the opposite ends of the magnetic member 532. Further, when the sliding friction between the conductive layer 522 of the fixing belt 520 and the magnetic member 532 is uniform over all of the longitudinal directions, it is assumed that the thermostat 54 inscribed on the magnetic member 532 is positioned at a portion deviated to the left side (−Y side) from the center in the longitudinal direction of the magnetic member 532 as illustrated in FIG. 4.

In such a case, a force applied to the right side from the thermostat main body 540 of the magnetic member 532 becomes stronger than a force applied to the left side, whereby the magnetic member 532 is inclined to the right side. Accordingly, sliding friction generated between the conductive layer 522 of the fixing belt 520 and the right side (+Y side) from the thermostat 54 of the magnetic member 532 becomes larger than sliding friction generated on the left side. Further, since the force for pressing the magnetic member 532 against the side of the conductive layer 522 of the fixing belt 520 by the pressing spring 542 is applied to the temperature detection component 546 of the thermostat 54, deviation in the longitudinal direction of the magnetic member 532 at a position of the temperature detection component 546 of the thermostat 54 increases a left-right imbalance of the sliding friction.

As a result, in the magnetic member 532, abrasion of the magnetic member 532 generated on the right side (+Y side) by the thermostat 54 becomes larger than that on the left side (−Y side), thereby causing a possibility that the magnetic member 532 may be inclined. In order to prevent such inclination of the magnetic member 532, the thermostat 54 may be disposed at the center in the longitudinal direction of the magnetic member 532 as illustrated FIG. 7.

In the fixer 52 according to the second embodiment, the reason why the thermostat 54 is disposed at the center portion in the longitudinal direction of the magnetic member 532 is as described above.

Third Embodiment

Figure 8:
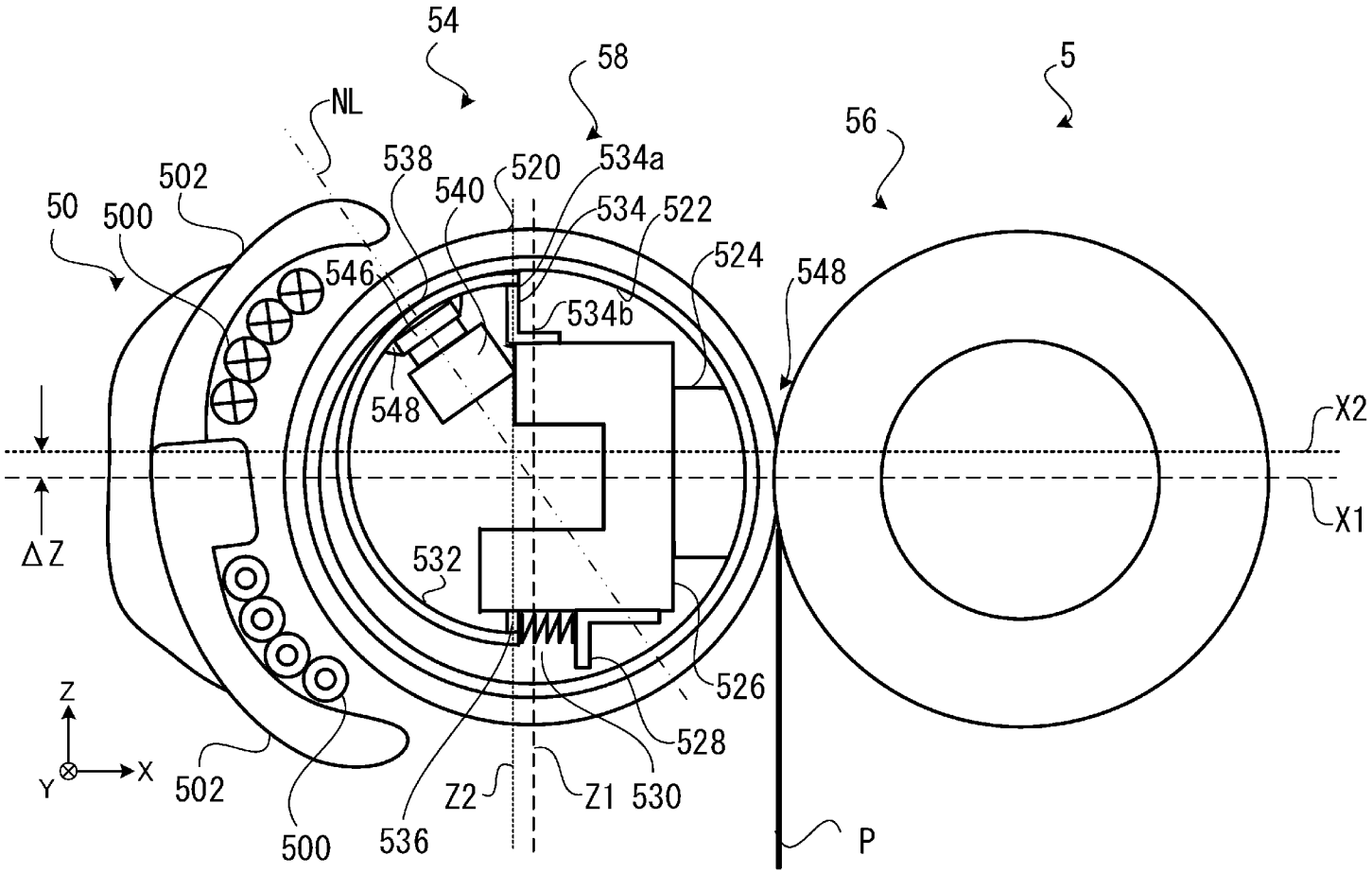
FIG. 8 illustrates a side view of a fixing device according to a third embodiment.

Hereinafter, a third embodiment will be described in detail with reference to the drawings. FIG. 8 illustrates a side view of a fixer 58 according to the third embodiment. In the fixer 58, the pressing spring 542 and the thermostat holder 544 of the thermostat 54 are omitted. Further, in the fixer 58, the thermostat main body 540 adheres to and is fixed to the magnetic member 532 by an epoxy-based adhesive 548 having good thermal conductivity at the close contact portion 538 between the conductive layer 522 of the fixing belt 520 and the magnetic member 532.

In the fixer 58, since the thermostat main body 540 is directly fixed to the magnetic member 532, the heat transport therebetween is stabilized. Further, since the thermostat main body 540 is not fixed to the support frame 526 via the pressing spring 542 and the thermostat holder 544 (FIG. 3), an imbalance of abrasion caused by the left-right imbalance of the sliding friction on the left and right sides of the thermostat main body 540 is not generated. That is, in the fixer 58, a drawback caused by the left-right imbalance of the sliding friction is eliminated. Further, in the fixer 58, the thermostat main body 540 may be fixed to any portion in the longitudinal direction of the magnetic member 532.

In the fixers 52 and 58 described above, since the heat transport is appropriately performed between the conductive layer 522 of the fixing belt 520 and the magnetic member 532, it is possible to prevent the unnecessary power supply interruption performed by the thermostat 54.

Further, in the fixers 52 and 58, the fixing belt 520, the conductive layer 522, and the cross sections thereof other than the nip part 548 may not be necessarily perfect circle, and alternatively, the cross sections thereof may not be appropriately the perfect circle according to a mechanical configuration of the main body part 2 and the like of the image forming apparatus 1. The circular arc of the cross section of the magnetic member 532 may also not be a part of the perfect circle, and the shape of the cross section of the magnetic member 532 is allowed to be deformed according to the mechanical configuration of the main body part 2 and the like of the image forming apparatus 1, and to have an error according to machining accuracy, use, and the like.

Further, the shape of the cross section of the fixing belt 520 and the conductive layer 522 and the shape of the cross section of the magnetic member 532 may be the circular arc of a part of the circle at the close contact portion 538, and may be deviated from the circular arc in other portions. In other words, the shape of the fixing belt 520 and the conductive layer 522 and the shape of the magnetic member 532 may include the circular arc.

Further, in the fixers 52 and 58, the conductive layer 522 of the fixing belt 520 and the magnetic member 532 may be formed to directly slide, or may be formed to slide via a glass cloth-shaped lubricating sheet in order to prevent damage on the conductive layer 522 of the fixing belt 520. Further, in order to reduce the sliding friction, a lubricant may be used at the close contact portion 538, or the close contact portion 538 may be coated with an appropriate material. Further, when the lubricant is used at the close contact portion 538 between the conductive layer 522 of the fixing belt 520 and the magnetic member 532, heat caused by the sliding friction is not generated, whereas heat caused by viscous resistance is generated at this portion.

Further, at the close contact portion 538 between the conductive layer 522 of the fixing belt 520 and the magnetic member 532, the magnetic member 532 may be subjected to a DLC (Diamond-Like Carbon) process, may be processed with CrN and Cr2N, or may be plated with Sn. Further, the temperature detection component 546 of the thermostat 54, the thermostat main body 540, and a component such as a bimetal (not illustrated) can be integrally formed.

Further, the adhesive with which the thermostat main body 540 adheres to the magnetic member 532 is not limited to an epoxy-based adhesive as long as the adhesive has good thermal conductivity. Further, the thermostat 54 can be replaced by a temperature sensor. In this case, according to the temperature detected by the temperature sensor, control is performed to reduce or interrupt the power supply to the coil 500 of the IH device 50 under the control of the control device 3. When the power supply to the coil 500 is reduced, the heat generation of the conductive layer 522 is also reduced, whereby the temperature of the fixing belt 520 is lowered.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fixing device, comprising:

a heating rotating body having a first arched portion so that a first circular arc is formed in a cross section configured to rotate to be pressed against a medium so as to heat toner on the medium;

an induction current generator disposed along the heating rotating body, configured to electromagnetically induce the heating rotating body by receiving supplied power; and an auxiliary heat-generating member having a second arched portion so that a second circular arc is formed in the cross section, the second arched portion being smaller than the first arched portion, the auxiliary heat-generating member configured to be supported at one end by a support member so as to be movable inside the heating rotating body and configured to contact with the first arched portion of the heating rotating body at a contact portion, the contact portion between the first arched portion and the second arched portion being closer to the support member than a middle point of the second circular arc is to the support member in the cross section, wherein a center of a circle which depicts the second circular arc is closer to the contact portion compared to a center of a circle which depicts the first circular arc.

2. The fixing device according to claim 1, wherein the heating rotating body is a fixing belt.

3. The fixing device according to claim 1, wherein the auxiliary heat-generating member is a magnetic member having a predetermined Curie temperature.

4. The fixing device according to claim 1, further comprising:

a thermostat provided at the contact portion configured to interrupt electric supply to the induction current generator when a temperature of the auxiliary heat-generating member exceeds a predetermined value.

5. The fixing device according to claim 4, wherein the thermostat includes a temperature detection component for detecting the temperature of the auxiliary heat-generating member, and the temperature detection component is disposed at the contact portion where the heating rotating body and the auxiliary heat-generating member are in close contact with each other.

6. The fixing device according to claim 5, wherein the temperature detection component is integrally formed with a component other than the temperature detection component of the thermostat.

7. The fixing device according to claim 5, wherein the temperature detection component is fixed to the auxiliary heat-generating member.

8. The fixing device according to claim 5, wherein the temperature detection component is disposed at a position to face the induction current generator.

9. An image forming apparatus, comprising:

an image forming unit configured to perform an image forming processes to form an image on a medium; and a fixing device configured to fix the image formed on the medium, wherein the fixing device comprises a heating rotating body having a first arched portion so that a first circular arc is formed in a cross section configured to rotate to be pressed against a medium so as to heat toner on the medium;

an induction current generator disposed along the heating rotating body, configured to electromagnetically induce the heating rotating body by receiving supplied power; and an auxiliary heat-generating member having a second arched portion so that a second circular arc is formed in the cross section, the second arched portion being smaller than the first arched portion, the auxiliary heat-generating member configured to be supported at one end by a support member so as to be movable inside the heating rotating body and configured to contact with the first arched portion of the heating rotating body at a contact portion, the contact portion between the first arched portion and the second arched portion being closer to the support member than a middle point of the second circular arc is to the support member in the cross section, wherein a center of a circle of the second circular arc is closer to the contact portion compared to a center of a circle of the first circular arc.

10. The image forming apparatus according to claim 9, wherein the heating rotating body is a fixing belt.

11. The image forming apparatus according to claim 9, wherein the auxiliary heat-generating member is a magnetic member having a predetermined Curie temperature.

12. The image forming apparatus according to claim 9, further comprising:

a thermostat configured to interrupt electric supply to the induction current generator when a temperature of the auxiliary heat-generating member exceeds a predetermined value.

13. The image forming apparatus according to claim 12, wherein the thermostat includes a temperature detection component for detecting the temperature of the auxiliary heat-generating member, and the temperature detection component is disposed at the contact portion where the heating rotating body and the auxiliary heat-generating member are in close contact with each other.

14. The image forming apparatus according to claim 13, wherein the temperature detection component is at least one of:

integrally formed with a component other than the temperature detection component of the thermostat;

fixed to the auxiliary heat-generating member; and disposed at a position to face the induction current generator.

15. A method of operating a fixing device, comprising:

rotating and pressing a heating rotating body having an inner cross section of a first circular arc and conductivity against a medium;

generating heat from an electromagnetically induced current to heat a toner transferred to the medium to be fixed;

electromagnetically inducing the heating rotating body by an induction current generator disposed along the heating rotating body by receiving supplied power; and supporting at one side of the cross section by a support member inside the heating rotating body an auxiliary heat-generating member having a cross section of a second circular arc smaller than the first circular arc, the auxiliary heat-generating member in close contact with the first circular arc included in the heating rotating body at a contact portion closer to the support member than a middle point of the second circular arc is to the support member in the cross section, wherein a center of a circle of the second circular arc is closer to the contact portion compared to a center of a circle of the first circular arc.

16. The method according to claim 15, further comprising:

interrupting electric supply to the induction current generator when a temperature of the auxiliary heat-generating member exceeds a predetermined value.

17. The method according to claim 16, further comprising:

detecting the temperature of the auxiliary heat-generating member.

18. The method according to claim 15, further comprising:

fixing an image on the medium.

* * * * *